US005431239A

United States Patent [19]

Tibbitts et al.

[11] Patent Number: 5,431,239

[45] Date of Patent: Jul. 11, 1995

[54] STUD DESIGN FOR DRILL BIT CUTTING ELEMENT

[76] Inventors: Gordon A. Tibbitts, 1378 Lakewood Cir., Salt Lake City, Utah 84117; Craig H. Cooley, 1815 S. 900 E., Bountiful, Utah 84010; Redd H. Smith, 1985 Sycamore La., Salt Lake City, Utah 84117; Paul E. Pastusek, 4519 Fortuna Way, Salt Lake City, Utah 84124; Ralph M. Horton, 5184 Spring Clover Dr., Murray, Utah 84123

[21] Appl. No.: 44,938

[22] Filed: Apr. 8, 1993

[51] Int. Cl.[6] ..... E21B 10/46

[52] U.S. Cl. ..... 175/428; 51/309; 175/432

[58] Field of Search ..... 175/425, 426, 428, 432, 175/433; 76/108.2; 51/309; 408/144, 145

[56] References Cited

U.S. PATENT DOCUMENTS

| | | | |
|---|---|---|---|
| 4,199,035 | 4/1980 | Thompson | 175/432 |
| 4,200,159 | 4/1980 | Peschel | 175/428 |
| 4,350,215 | 9/1982 | Radtke | 175/433 |
| 4,351,401 | 9/1982 | Fielder | 175/428 |
| 4,382,477 | 5/1983 | Barr | 175/428 |
| 4,398,952 | 8/1983 | Drake | 419/18 |
| 4,484,644 | 11/1984 | Cook et al. | 175/420.1 |
| 4,498,549 | 2/1985 | Jurgens | 175/430 |
| 4,505,342 | 3/1985 | Barr et al. | 175/428 |
| 4,593,777 | 6/1986 | Barr | 175/379 |
| 4,705,122 | 11/1987 | Wardley et al. | 175/430 |
| 4,705,123 | 11/1987 | Dennis | 175/428 |
| 4,714,120 | 12/1987 | King | 175/431 |
| 4,718,505 | 1/1988 | Fuller | 175/428 |
| 4,749,052 | 7/1988 | Dennis | 175/432 |
| 4,862,977 | 9/1989 | Barr et al. | 175/432 |
| 4,877,096 | 10/1989 | Tibbitts | 175/432 |
| 5,279,375 | 1/1994 | Tibbitts et al. | 175/428 |

FOREIGN PATENT DOCUMENTS

| | | | |
|---|---|---|---|
| 202994 | 7/1992 | Japan | 76/108.2 |
| 227255 | 9/1968 | U.S.S.R. | 175/426 |

*Primary Examiner*—David J. Bagnell

[57] ABSTRACT

An improved stud design for an earth boring drill bit is disclosed preferably using materials of different hardness and toughness layered to provide maximum resistance to surface abrasion coupled with excellent structural properties including high strength with maximum fracture toughness. The bit body is conventionally attached to a drill string, and has a crown and gage portion. The studs preferably include a core, made of steel or other material having high fracture toughness, covered at least in part with a hard, abrasion resistant material such as tungsten carbide. Each stud is secured to a socket in the bit body by means of brazing or other suitable means such as a press fit. The cutting element is brazed to a mounting face of the stud prior to affixation of the stud to the bit body and is preferably comprised of a polycrystalline diamond compact adhered to a backing layer of tungsten carbide.

44 Claims, 10 Drawing Sheets

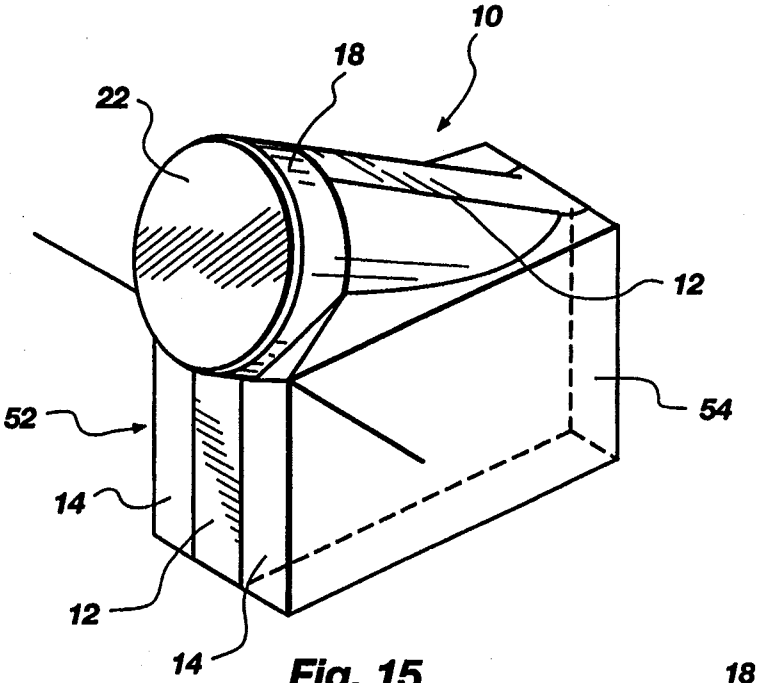
Fig. 15
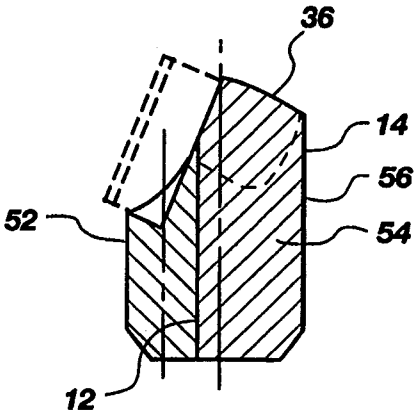
Fig. 16
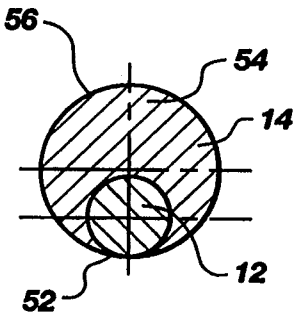
Fig. 17
Fig. 18
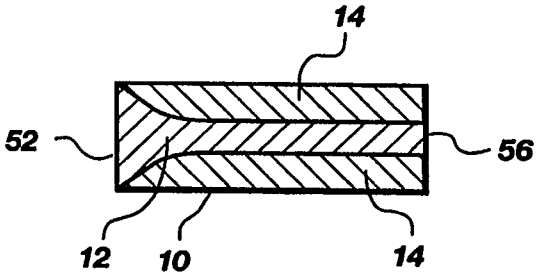
Fig. 19

STUD DESIGN FOR DRILL BIT CUTTING ELEMENT

BACKGROUND OF THE INVENTION

1. Field of the Invention

This invention relates generally to fixed cutter rotary drag bits for earth boring, and more particularly to improvements in bit design. Specifically, this invention relates to the design of stud type carrier elements inserted into the body of a drill bit to support cutting elements mounted on the carrier elements.

2. State of the Art

Fixed cutter rotary drag bits for subterranean earth boring have been employed for decades. Fastened to the bottom of a rotating drill string, a drag bit chips, shears, or plows the earth formation ahead of it, the formation debris or cuttings flowing upward in an annular column of drilling fluid or "mud," surrounding the drill string. Mud is typically injected through nozzles in the bit face to cool and clean cutting surfaces of cutting elements on the bit face and to carry away the cuttings up the well bore annulus.

The bit body is typically of steel or of a matrix of tungsten carbide, the former type being usually forged or cast, while liquid infiltration powdered metal matrix metallurgy is generally employed in the latter. Finish machining of either type bit body may be performed by various methods known in the art, as may hardsurfacing of the bit face, depending on material properties of the body.

Inserts called studs are fixed to the bit body. The studs comprise a carrier element and a cutting element. The carrier element's function is structural and the cutting element's function is to chip, shear, or plow material from the earth formation being drilled by the bit. The carrier elements are secured by interference fit, threads, welding, brazing or other means in openings provided for them in the face of the bit body. Buttresses on the bit body often back up the carrier elements to add support. The studs thus protrude in rows or arcuate arrays extending from near the center radially across the face of the bit body to the gage and usually for some axial distance, many bits having conical or parabolic profiles. The cutting elements, usually brazed to the carrier elements, typically are polycrystalline diamond compacts ("PDCs") (sometimes called preforms) comprised of a cutting face of diamond bonded during manufacture to a layer of tungsten carbide.

Prior Art:

U.S. Pat. Nos. 4,199,035; 4,200,159; 4,350,215; 4,351,401; 4,382,477; 4,398,952; 4,484,644; 4,498,549; 4,505,342; 4,593,777; 4,705,122; 4,714,120; 4,718,505; 4,749,052; 4,877,096 and 4,884,477 address the configurations, manufacture, utility, and governing considerations of matrix bits. The foregoing patents are incorporated by reference here for their teachings of cutting elements, carrier elements and matrix bits using them.

U.S. Pat. No. 4,199,035 (Thompson, 1980) discusses a method of threadedly attaching a stud in a bit body. The patent discusses the construction of a compact, a cluster of abrasive particles or crystals bonded together either by self bonding or bonding by means of a medium disposed between the crystals or some combination of both methods. Noting the large variety of dynamic loads to which cutting elements are exposed during drilling, the patent identifies the importance of repair of individual cutters in a bit. The patent points out the impracticality of repairing permanently mounted cutters.

U.S. Pat. No. 4,200,159 (Peschel et al., 1980) discusses the technique of making carrier elements having cutting elements mounted on them separately from the bit body. The patent also discusses the difficulty of forming the diamond materials in situ together with the bit body due to thermally-induced diamond degradation and lack of replaceability of broken cutting elements, giving rise to the need for a stud-type bit.

U.S. Pat. No. 4,350,215 (Radtke, 1982) discusses the manufacture of drill bits, including the formation of a bit body with pockets into which the cutting elements are brazed.

U.S. Pat. No. 4,351,401 (Fielder, 1982) discusses a matrix drag bit using diamond preform cutters mounted on studs positioned in sockets in the face of the bit. The patent discusses the advantage of cutters arranged on studs in the face of the bit for maintaining compression on the cutters rather than tension due to bending forces. This highlights the importance of avoiding bending since materials with low toughness may fail precipitously in tension. Also, the patent discusses the value of being able to replace a single preform which has been damaged rather than having to salvage the entire bit. That is, it is much more economical to salvage a bit by repairing a damaged preform, stud, etc. rather than having to destroy the bit to recover all of the preforms having useful life remaining.

U.S. Pat. No. 4,382,477 (Barr, 1983) discusses the use of "preform" cutting elements made with diamond facing on a backing layer of tungsten carbide which is mounted on a support member mounted on a drill bit. The patent discusses at length the variety of stresses experienced by the preform and the importance of believing the various stresses. Among the difficulties are the increased friction on the formation due to having a hardened underlying supporting material behind the preform. Likewise, the resulting heat weakens braze. Perhaps most importantly here, the '477 patent discusses the deformation which the preform must undergo due to deformation of the underlying support member and underscores the need for resilience of cutters.

U.S. Pat. No. 4,398,952 (Drake, 1983) discusses a method for forming rolling cutter bits. The method involves providing a first powder mixture comprising mainly a refractory with a minor proportion of binder metal. A second powder comprises a powder binder metal with the powder refractory material in a lesser proportion than the first powder. The method involves mixing the powders in differing proportions starting with a majority of the first powder (giving rise to harder material) and eventually at the inner most region of a mold having a nearly 100% composition of the second powder. The result is a gradient in the roller cutter composition once the mold filled with the powdered mixture is sintered.

U.S. Pat. No. 4,484,644 (Cook et al., 1984) discusses a powder metallurgy technique of making steel and tungsten carbide forgings with a 100% density and having a hardness gradient along the length of the foregoing. The articles so formed can serve as the inserts or studs in rock cutting bits.

U.S. Pat. No. 4,498,549 (Jürgens, 1985) discusses drill bit cutting structures comprising segments of PDCs bonded with adjacent blanks to carrier elements.

U.S. Pat. No. 4,505,342 (Barr et al., 1985) discusses drag-type well drilling bits. The patent discusses the use of PDCs mounted on studs inserted into a bit body to form a bit. The patent also discusses the difficulties of cooling, integrity, and the cracking and shearing of the studs as well as the need for resilience in the bit body.

U.S. Pat. No. 4,593,777 (Barr, 1986) discusses at length the importance of the orientation of the cutting face of a drill bit compared to the formation which is being drilled. The patent discusses at length the importance of rake angle, the angle formed by the cutting edge and the formation, in achieving rate of penetration (ROP) in various types of formations. The patent also discusses some of the trade-offs between maximum ROP in soft formations and maximum wear in hard formations without having to extract the drill string from the hole in order to change drill bits. The patent also discusses the tradeoff of material properties between the various components of a drill bit using stud-type cutting elements.

U.S. Pat. No. 4,705,122 (Wardley et al., 1987) discusses a preform cutting element comprising a circular tablet having a polycrystalline diamond face bonded to a backing layer of tungsten carbide mounted on a stud inserted in a bit body. The stud is basically cylindrical. This classic geometry is common to the industry. However, the patent does highlight the need for proper orientation of the cutting face of the cutting element and the need for an open area in front of the cutting face for carrying away debris. In addition, it discloses the need for support in the stud for the dynamic loads applied to the cutting element and the surface of the stud.

U.S. Pat. No. 4,714,120 (King, 1987) discusses a scheme to make cutters in pairs along the crown of a matrix-type bit body to make the cutting elements less susceptible to gross failure by shearing.

U.S. Pat. No. 4,718,505 (Fuller, 1988) discloses an abrasive element which follows a cutting element in a matrix bit using studs, in the event of the failure of a stud. The patent identifies the need to maintain some ability to cut in the event of failure or excessive wear of the principal cutting edge of a cutting element mounted on a carrier element (stud).

U.S. Pat. No. 4,749,052 (Dennis, 1988) discusses the placement of round cross-sectional studs into recesses in the face of a drill bit for attachment by press-fit or brazing.

U.S. Pat. No. 4,877,096 (Tibbitts, 1989) discusses a replaceable stud cutter for use in matrix drag bits. The patent discusses the prior art practice of destroying an entire bit body when cutters are worn in order to recover or salvage diamond cutters for future use on other bits. Likewise, since some cutters on a bit may be damaged while others are in useful condition, the —096 patent addresses the issue of cutter replacement to extend the life of a bit.

U.S. Pat. No. 4,884,477 (Smith et al., 1989) discusses the construction of a rotary drill bit of the metal matrix type having cutting elements mounted on its exterior. The patent discusses providing a rotary drill bit which has at least some portion of its construction of the metal matrix made of tungsten carbide. Provision of a substitute filler material mixed with the tungsten carbide improves the toughness of the bit. A technique of hard-facing such tougher bits for enhanced abrasion and erosion resistance is also disclosed.

Stud-type carrier elements are generally of harder and stronger materials than the bit body and can resist abrasion from the formation and its resulting debris and erosion from solids-laden drilling mud. Harder materials often have low toughness but high strength, thus supporting high stresses, so long as their surface integrity remains. That is, even for strong materials, low toughness may cause fractures to progress through a member rapidly once outermost surfaces are compromised by minute cracks.

However, the ultimate strength of a high toughness material is typically reached after absorption of substantial energy through plastic strain. Material of low toughness, on the other hand, typically reaches ultimate strength after only slight energy absorption through plastic deformation. The result is that a low toughness material may be very strong and functional while it lasts, but unforgiving of flaws.

Another key factor in the use of hard material of low toughness is the presence of surface defects which cause stress concentrations. Glass demonstrates this phenomenon. Glass free of inclusions and surface defects is strong, supporting substantial loads even in bending. However, when glass is exposed to the atmosphere, airborne impurities etch the glass causing microscopic imperfections or cracks in the surface. Since the glass is so unyielding, stresses resulting in the surface of the glass tend to concentrate in the tiny region at the leading edge of the cracks. Such stress, if not reduced over a broader area through local yielding of the material, maintains the stress concentrations at the leading edge of each of the surface imperfections even as each crack advances in response. The region around the tip of the crack fractures, rather than elongating, applying the stress concentration at the new location of the tip. With the application of additional stress or repeated stress the imperfection advances completely through the material, sometimes very rapidly, eventually fracturing (rupturing) the entire cross section of the material.

Other materials of low toughness behave similarly. Without some ability to permit yielding locally around cracks, total rupture of a section of material can occur rapidly. Given the grinding, chipping, abrading and eroding nature of the drilling environment, surface defects in materials of low toughness can create stress concentrations in studs formed of such materials, which stress concentrations eventually fracture the studs. Thus, unless possessed of high toughness, a hard stud which reduces the effects of abrasion will be more subject to fracture. A tougher material less subject to catastrophic fracture will be more subject to abrasion and erosion. Whether a stud is abraded or eroded, broken away from its brazed position in the bit body or fractured, it is rendered equally useless.

The cutting of an earth formation by a drill bit is actually accomplished by the action of the cutting elements which are attached to faces of the free ends of the carrier elements secured in the bit body. The cutting elements are generally of superhard material such as synthetic diamond, previously referred to herein as polycrystalline diamond compacts or "PDCs," although other materials such as cubic boron nitride have been employed. Polycrystalline diamond compacts (PDCs) are cutting elements having a tungsten carbide substrate on which a diamond face is formed with a catalyzing metal by application of extreme heat and pressure.

Stresses resulting in a stud during operation of a drill bit may include, individually or in combination, bending, shear, tension and compression caused by the earth formation resisting the stud's motion on its cutting (free) end while the bit body drives forward the other (secured) end axially and tangentially with respect to the direction of advance of the drill bit. The stresses occur in different locations and to differing degrees. Also, the extent of a stress varies depending on its type and location.

On the other hand, tensile stress due to bending of an axially inserted, cylindrical carrier element as it supports the cutting element transversely can be very large. That force can also be exacerbated by the stress concentration at the locus of contact between the carrier element and the bit body.

Moreover, as explained above, any material of comparatively low toughness, including some tungsten carbides (WC) will be comparatively unyielding in tension. This characteristic results in a component of low toughness which breaks upon reaching its ultimate stress. However that stress level is more easily reached in the presence of stress concentrations from a change in material cross section at the point of penetration into the bit body, at any stress discontinuity or at a material flaw such as a small crack or notch. As explained above, such stress concentrations enhance propagation of cracks.

By contrast, materials with relatively high fracture toughness such as some steels, high-cobalt-content tungsten carbides, or large-grain-size tungsten carbides, will yield locally under sufficient stress, relieving the stress over a region and thus stopping the propagation of a crack. The high inertia and energy input of a drill string can result in very high dynamic loads. A very high dynamic load of very short duration may cause a fracture. Thus, a surface flaw need not be substantial, or exist for a long time to propagate. Although cracks can propagate slowly across a section over time, they can also propagate instantly. Lower toughness materials tend to fail with more rapid propagation of cracks. In such material, the crack may propagate quickly to catastrophic failure under high stress, such as dynamic loading often imposes.

In bending, the maximum stress in a section symmetric about its neutral axis (typically the centerplane perpendicular to the applied force) is on the outermost fiber. The outermost fiber exists at the outer surface at a maximum distance from the neutral axis. In a cylindrically shaped stud cantilevered from a close fitting penetration in a bit body, for example, bending forces imposed by the cutting face at the free end apply maximum tension at the surface of the stud on the side on which the force is applied. Maximum compression occurs on the diametrically opposite surface at the position where the stud enters the bit body.

A commonly employed stud is a cylindrical rod, for ease of manufacture and to fit in maximum numbers over the surface of a small bit body. The strongest stud materials of maximum toughness (consistent with cost) are desirable. However, materials with relatively high erosion and wear resistance but low toughness are typically used. The stud should extend the maximum distance possible from the surface of the bit body to allow space for chips of debris to pass to prevent clogging or "bailing" of the bit. This configuration, however, creates the highest bending stress. Of course, the cutting edge must be at the furthest extremity of the stud to contact the formation. Preferred sizes and spacing of cutters must actually be balanced against the properties of available materials. Thus, in reality, various shapes and configurations will result as each limiting factor is incorporated in a design. However, the tradeoffs to be made are not always apparent, even with idealized parameters.

A material which minimizes abrasion may have low toughness and thus be susceptible to stress concentrations, stress corrosion cracking, and rapid crack propagation, which undermine its structural integrity. A material which can resist such fracture by its toughness may be easily abraded.

Sources of reduced working stress include the interference fit of a stud into an opening in a drill bit body. Even without press-fitting, for example, if the studs are brazed in holes in the bit face, the difference in the coefficients of thermal expansion of dissimilar metals (stud and bit body) introduces residual stresses after the brazing process as the drill bit cools down.

At the point of stud penetration into the bit body, a change in effective cross section occurs over which stress is spread. This change in cross section causes a stress concentration effect. Both effects can reduce the maximum working load permissible. Residual stress of mounting and the restraint imposed by the bit body may also increase plane stress locally in the stud.

The compressive stresses in the stud will also tend to reduce the maximum tensile stress which the stud can support normal thereto. Thus, the tolerable bending load of a cantilevered stud is reduced when compressive stress is applied, such as by an interference fit.

cutter wear characteristics can, and often do, dictate the useful life of a drill bit. Tremendous costs result if cutters wear out prematurely at the bottom of a drill hole several thousand feet deep, the bit cost itself being a small portion of the total rig time and personnel cost involved in retrieving and replacing the bit in such a circumstance.

The mechanical fracture of even one stud may be even more catastrophic, as such an occurrence can stop a drill bit's progress by failing to cut its share of the formation. Bit replacement is necessary when a missing cutting element leaves an uncut cylinder or annular collar remaining on the formation for the bit to ride upon. Thus, if a stud breaks down for any reason, the bit may eventually stop cutting and merely ride on the uncut formation even if all of the other cutters remain intact and fully functional. Such a failure results in a bit replacement requiring tripping in and out of the hole.

One solution to the problem, to date unaddressed by the prior art, is to manufacture tough studs having a hard surface. In order to create such a stud having maximum fracture toughness with maximum surface hardness, a composite structure having different characteristics across its cross section is desirable. Also, means to reduce stress concentrations due to loading or material flaws is needed.

SUMMARY OF THE INVENTION

The present invention comprises a composite stud structure having different material characteristics across its structural cross section to provide the abrasion resistance of hard materials combined with fracture resistance, called fracture toughness. The invention includes a stud structure in which outer surfaces constitute an amount of material sufficiently hard or hardened to resist abrasion and erosion combined with an adjacent portion having tougher material properties. The tough material resists propagation of surface cracks into the body of the stud. Similarly, the tough material provides general yielding if necessary, and is more resistant to fracturing of the stud.

Other embodiments of the invention rely on geometry changes or pre-stressing to improve fracture resistance. These embodiments include studs having multiple materials, different fracture toughnesses, and studs comprised of a homogenous material having a single value of fracture toughness.

Several other phenomena contributing to breakage of studs can be improved by the instant invention. First, by increasing toughness to allow localized yielding without fracture so that stresses can be distributed more evenly across the cross section of a stud, the stress level at the outermost fiber is reduced. Second, working stress capacity can be increased by eliminating compressive loads imposed by interference fits. Third, the stress concentration factor, due to a discontinuity in materials or material properties at the point in the stud where it penetrates the surface of the bit body, is reduced or eliminated by several of the embodiments of the invention. Fourth, pre-stressing a stud can change the stress distribution as well as pre-loading portions of the stud. When loaded in compression, the outermost surface of a stud can support substantially more tension loading before reaching the limits of its tensile stress.

BRIEF DESCRIPTION OF THE DRAWINGS

FIG. 5B is a side view of a section of the stud of

FIG. 5A having graduated material properties with maximum toughness at the center and maximum hardness at the outer surface;

FIG. 15 is a perspective view of a self-buttressing stud having tough interior material sandwiched between hard materials at the outside faces of a rectangular base;

FIG. 16 is a side view of a section of a stud base having a tough core placed eccentrically toward the front of the stud base of harder material;

FIG. 17 is a top view of the cross section of the stud base of FIG. 16;

FIG. 18 is a side view of a section of a rectangular stud base.

FIG. 19 is a top view of a cross section of the stud base of FIG. 18 showing the interior core of tough material protected by the abrasion resistance layers of hard material;

DETAILED DESCRIPTION OF THE PREFERRED EMBODIMENTS

Figure 2:
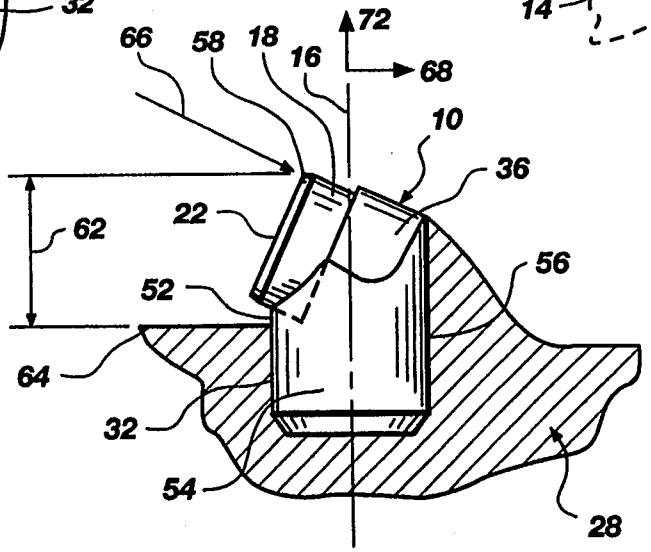
FIG. 2 is a side view of a section of a stud installed is a drill bit body.
Figure 1:
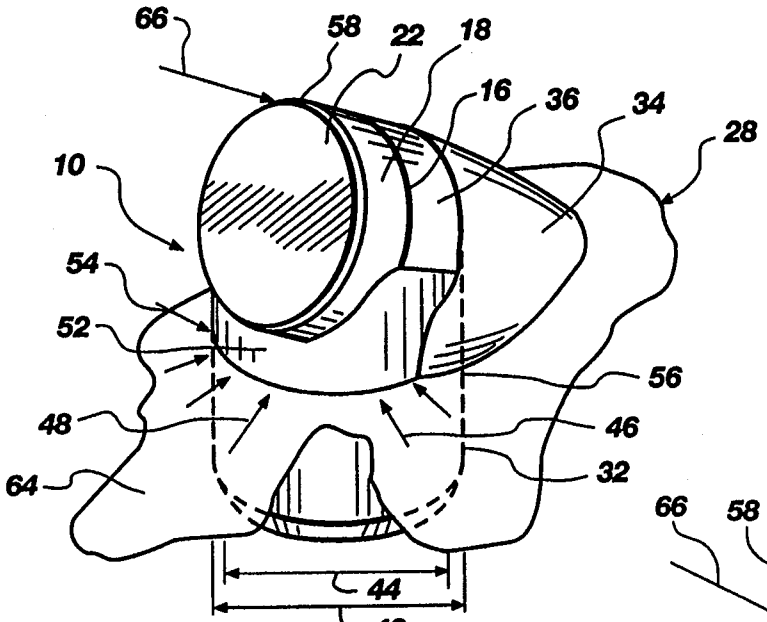
FIG. 1 is a perspective view of a conventional stud mounting scheme.

In FIGS. 1 and 2, a conventional cutting element mounting method is shown wherein a stud such as stud 10 of the present invention is secured to the bit body 28 by a method which can result in residual stress. That is, in a press fit or heat shrinking, used by some manufacturers, or cooling of dissimilar materials after brazing; stud 10 may have stud diameter 42 larger than cavity diameter 44 of cavity 32 when the bit body material is in an unstressed or relaxed state. The resultant compressive stress in direction 46 arises in the stud 10 while a tensile stress results in direction 48 within the bit body 28. To minimize these stresses, stud diameter 42 is preferably less than cavity diameter 44, and stud 10 is secured by adhesive or braze. The bending moment imposed on stud 10 by the formation during drilling imposes maximum tension in the outermost fiber in the frontal region 52 of the stud base 54. The presence of a buttress 34 supporting stud 10 reduces stress due to bending.

The stud installation method employed with the present invention is not limited to the embodiments described herein. Some bending stresses will be imposed on stud 10 regardless of its method of affixation to the bit body 28, including tension in the frontal region 52 of stud base 54. Diametrically opposed to frontal region 52, back region 56 experiences axial compression due to the same bending load applied normal to the cutting face 22.

If stud base 54 is made of a monolithic material of sufficient hardness to resist abrasion, then the axial tension stress induced in the frontal region 52 of stud base 54 will enhance propagation of cracks through the cross section of stud base 54. Even in a preferred construction where brazing rather than press fitting secures the stud base 54, stress discontinuities at the interface where stud base 54 penetrates bit body 28 can exacerbate the fracture of studs under dynamic loads.

The structural effects are several when the earth formation being cut exerts forces at the cutting edge 58 of cutting face 22. Besides the general compression of the stud 10 against the buttress 34, the reach 62 of the cutting edge 58 above the bit body surface 64 allows the debris from the cutting process to be flushed away by the drilling fluid as it cleans and cools the cutting edge 58 and the cutting face 22 generally. The reach 62 also creates a lever arm for bending the stud 10 creating the tension force in the frontal region 52 as discussed above. However, an interference fit between the cavity 32 and the stud base 54 creates a radially inward compression force on the frontal region 52 which thereby decreases the maximum allowable axial tension in the frontal region 52.

A stress discontinuity can be caused not only by unequal loads in close proximity, but also by a change in section of a loaded member. The sometimes dramatic difference in section between a stud base 54 and a bit body 28 causes a stress discontinuity in stud base 54 where it penetrates the bit body surface.

Thus, a tradeoff exists between the need for a large reach 62 to keep cutting face 22 clean and to provide the region behind buttress 34 available for sweeping debris away from the bit body 28 against the competing consideration of minimizing the leverage which the cutting force 66 operates on to create bending in the stud base 54 with resultant tension in the frontal region 52 about reach 62. Stated another way, reach 62 comprises the effective lever arm on which the component of cutting force 66 in the transverse direction 68 acts to create the tension force in the axial direction 72 at frontal region 52. In addition, the extent to which the reach 62 protrudes above buttress 34 can also induce bending and tension forces in the cutting face 22 and the backing layer 18.

Nevertheless, the primary tradeoff in determining protrusion is between the need for clear, unobstructed areas to carry away debris and conduct drilling fluids and the need to reduce the bending moment on the stud base 54.

Figure 3:
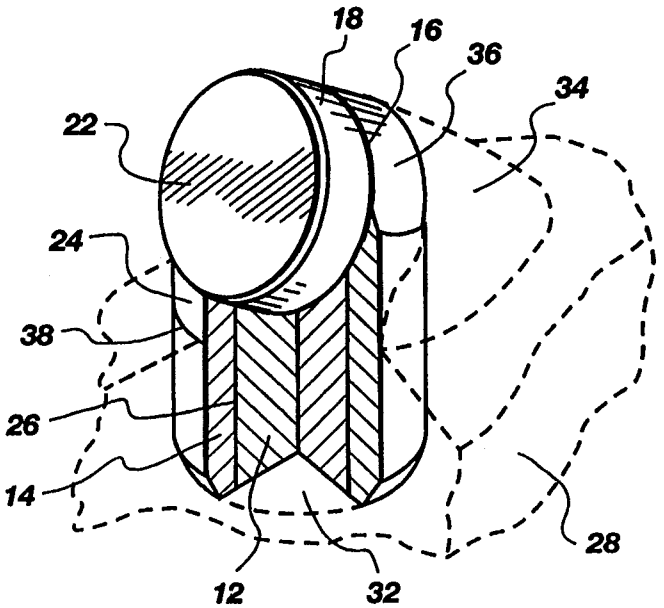
FIG. 3 is a cut-away perspective view of a preferred embodiment of the stud design of the invention.
Figure 5B:
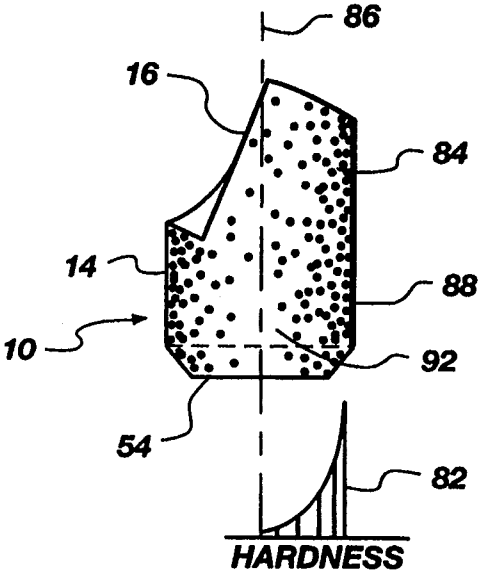
Figure 5A:
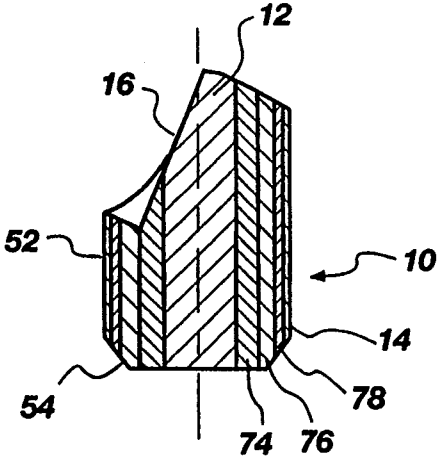
FIG. 5A is a sectioned view of a multi-layered stud with graduated material layers of maximum toughness near the center and maximum hardness near the outer surface.
Figure 4:
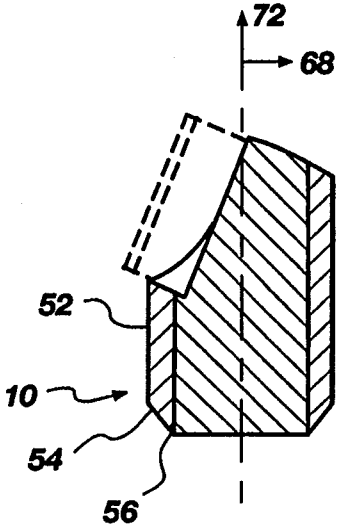
FIG. 4 is a side sectional view of the stud of FIG. 3.

Stud 10 of the present invention as depicted in FIGS. 3 and 4 as well as the alternate embodiments of FIGS. 5A and 5B solve a number of the above-described problems existing in conventional studs inserted in the bit bodies of drilling bits.

In FIG. 3, the improved stud 10 of the present invention is shown in partial cut-away view, being comprised of an inner core 12 of material having a higher or enhanced fracture toughness, such as steel, large-grain-size tungsten carbide, high-cobalt-content tungsten carbide, tantalum carbide or super alloy such as stellite, surrounded by an outer layer 14 of hard, abrasion resistant material. A typical material is low-cobalt, cemented tungsten carbide. Although 6% cobalt is possible, about 9–12% cobalt is the range preferred. In general, a hard material of low metal binder content capable of bonding to core materials should suffice.

Cobalt content usually ranges between 6 and 20 percent in cemented tungsten carbides. High cobalt content is greater than about 15%. Carbide grain size and cobalt content can both be varied to design for strength or high fracture toughness. The stud 10 is further provided with a mounting surface 16 to which is secured by brazing or other suitable means a backing layer or substrate 18. A cutting face 22 is usually attached to the backing layer 18. The cutting face 22 is usually manufactured of a superhard material, as that term is used in the art, having polycrystalline diamond bonded under high temperature and pressure to the backing layer 18 in a separate manufacturing process prior to attachment of the backing layer 18 to the stud 10 at the mounting surface 16. The inner core 12 of stud 10 is a material having relatively high fracture toughness. Thus, if a surface imperfection in outer surface 24 propagates as a crack in outer layer 14, the crack is arrested at material interface 26 when it encounters the tough inner core 12.

The stud 10 may be secured in the bit body 28 shown in phantom in FIG. 1. The stud 10 is fitted inside a cavity or recess 32 formed in the bit body 28 for receiving the stud 10. The bit body 28 is also provided typically with a buttress 34 which functions to reduce bending of stud 10 and to maintain the backing layer 18 and the stud 10 in compression against the buttress 34 when the cutting face 22 is forced against the formation being drilled. The peak 36 of stud 10 is shaped to conform to the face shape or diameter of the cutting face 22, backing layer 18 and the buttress 34 to create a smooth contour among them.

A buttress 34 made as part of a bit body 28 may deform, inadequately supporting the stud in bending. Thus, the load resulting from cutting force 66 which should be shared by buttress 34 and the stud 10 may inordinately burden the stud 10. One aspect of the invention is to make the stud base 54 in a self buttressing shape. (See FIGS. 12, 13A, 13B, 13C and 14).

If the stress in stud 10 becomes too high, the inner core 12, being made of a tougher and typically lower yield stress material, will yield locally at a point of maximum stress, thus spreading the stress over a broader area and generally limiting the maximum stress in stud 10.

Stress concentrations particularly aggravate crack growth. Many hard materials have low toughness, being susceptible to rapid crack growth. The present invention reduces crack growth in two ways. Because of the inner core 12 having a high fracture toughness, and lower yield stress, crack growth is reduced throughout the inner core. In addition, the material interface 26 should tend to arrest crack growth at the discontinuity in materials. That is, at a microscopic level, fracture of materials is a separation of atoms. If inner core 12 is comprised of different atoms than the outer layer 14, it tends to arrest crack propagation at the interface. Moreover, because the inner core 12 is of a material with high fracture toughness, crack growth would tend not to progress into it.

If additional layers having differing material characteristics are added in the stud 10, whether circumferential around the circumference of the stud 10, or diametral through the stud 10, stresses, yielding, and any crack propagation will be likewise mitigated. That is, if two parallel layers together support a load, a layered composite having alternating layers of hard and tough materials will have an intermediate strength and toughness compared to those properties if it were made of either material alone. Therefore, the invention as disclosed may achieve many of its same benefits in a multiplicity of embodiments.

In FIG. 5A, the stud 10 is comprised of a first intermediate layer 74, of a material slightly harder than the inner core 12, a second intermediate layer 76 of a material yet harder than the first intermediate layer 74, and the third intermediate layer 78 of a hardness greater than the second intermediate layer 76, all existing underneath the outer layer 14 which is of maximum hardness. This configuration gives maximum reduction of crack growth with its several material discontinuities. It also achieves the benefits sought by way of localized stress reduction.

FIG. 5A demonstrates yet another embodiment. Inner core 12, second intermediate layer 76 and outer layer 14 may be of a hard material with a low coefficient of thermal expansion. First and second intermediate layers 74, 78 may be of a high-toughness material having a high coefficient of thermal expansion. After assembly and hipping at high temperature, the high-toughness material in first and third intermediate layers 74, 78 has become bonded to the hard material in core 12, outer layer 14 and second intermediate layer 76. Upon cooling of the stud 10, the high-toughness material of first and third intermediate layers 74, 78 prestresses the hard material in core 12, outer layer 14 and second intermediate layer 76. More layers or fewer may be used to secure the benefits of this embodiment. Key process factors are relative hardness, toughness and thermal expansion of materials used.

FIG. 5B shows a continuous gradation 82 of hardness of stud 10 of FIG. 5A, beginning with the hardest properties at the outermost surface 84 and a minimum hardness, maximum toughness at a central axis 86. This configuration yields a continuum or gradient of material properties. It may be created by layering various combinations of powdered metals of the desired minimum and maximum hardness together and sintering or hipping them into a single body from which the studs 10 are formed. Thus, a combination of hardest material particles 88 (comprising the exterior surface of stud 10) interspersed in various percentages in adjacent layers or jackets with the toughest material particles 92 (comprising the center of stud 10) are hipped or sintered together to become an integral stud 10 with a continuous graduation 82 of material hardness.

Figure 6:
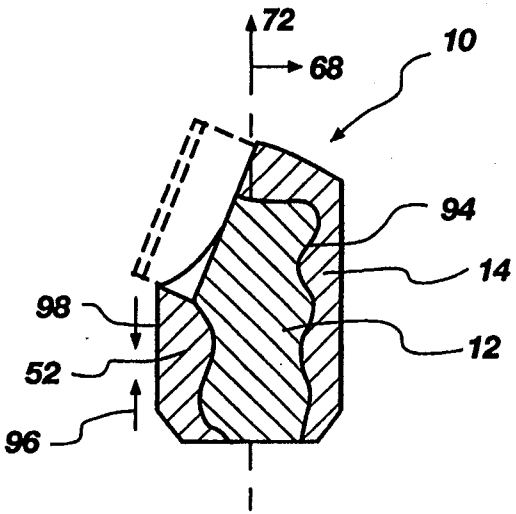
FIG. 6 is a side view of a section of a stud wherein the core material has a greater coefficient of thermal expansion and the outer shell material has a lower coefficient of thermal expansion to create tension in the core and compression in the shell upon cooling of a newly manufactured stud.

FIG. 6 shows a method of embodying the invention by preloading of the outer layer 14. In this embodiment, a stud 10 is manufactured by casting, forging or by a similar process and the inner core 12 has a higher coefficient of thermal expansion than an outer layer 14. By creating a core locking surface 94 between the inner core 12 and the outer layer 14, the increased shrinkage upon cooling of the structure accruing to the inner core 12 paired with the substantially less shrinkage experienced in the outer layer 14 creates tension in the inner core 12 with compression in the outer layer 14. Thus, the frontal region 52 experiences axial compression 96 essentially preloading the frontal region 52 and allowing it to carry a higher tensile load.

Figure 7:
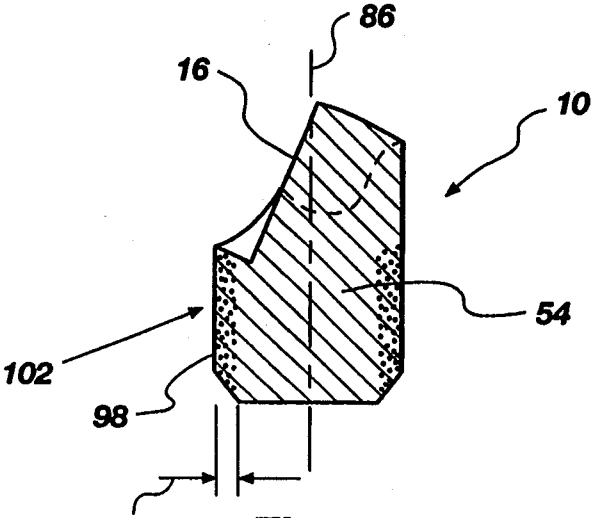
FIG. 7 is a side view of a section of a stud design in which the outermost surface of the stud is processed with implanted ions to create an abrasion resistant surface layer prestressed in compression by oversized atoms in an atomically disordered structure.

Similar to the approach of FIG. 5B is the concept of FIG. 7 wherein an implanted ion region 102 can be made by a combination of electrical energy and possible heating of the surface 98 to either displace or to chemically harden the outer layers of atoms to some depth 104 from the surface 98 of stud. 10. The implant process can be performed by ion bombardment or implantation. The effect is that oversized atoms become embedded in the lattice of the base material putting the lattice in compression. The pre-stressing by this compressive load allows higher tensile loads in the frontal region 52 before maximum allowable stress is reached.

Figure 8:
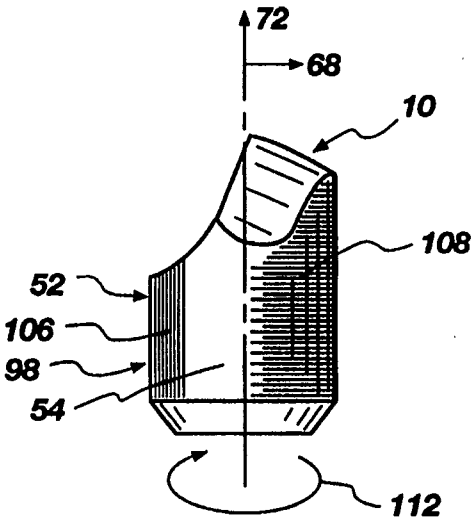
FIG. 8 is a side view of a stud design in which the external surface of the stud has been ground in a direction parallel to the axis of the stud to reduce stress concentrations due to improperly oriented surface flaws.

FIG. 8 shows an additional embodiment which adds an improvement to reduce stress concentrations. On the frontal region 52 of the stud base 54 of the stud 10, axial grinding of the stud's surface is done so that axially oriented grinding marks 106 are left in the outer surface 98 of frontal region 52 rather than the circumferential grinding marks 108 which are left by a conventional rotary motion between the grinder and the stud 10 during a conventional grinding operation. The resulting effect of the axial grinding is to re-orient the residual grinding cuts which might otherwise run in the circumferential direction 112. Such orientation could reduce stress concentrations which might become cracks under bending loads. This construction, like many other configurations, can be used with or without fracture resistant cores of material different than that of the outer surface.

Figure 9:
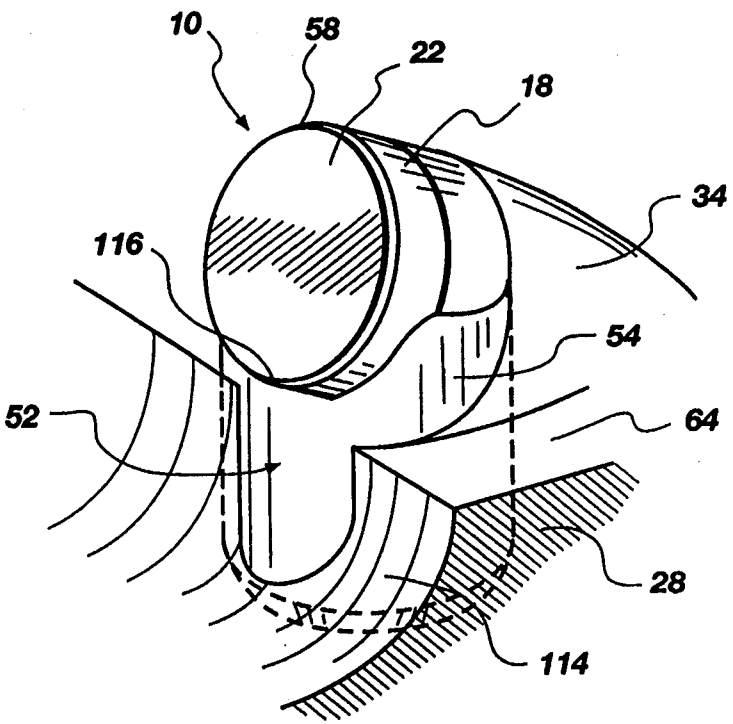
FIG. 9 is a perspective view of a stud installed in the bit body to expose the frontal portion of the stud base.

FIG. 9 demonstrates additional improvements to be gained in the method of mounting the stud 10 by making a clearance cut 114 to further excavate the bit body 28 away from the frontal region 52 of the stud base 54. Several beneficial effects thereby accrue to the performance of the stud 10. Debris cut by the cutting face 22, since it is opposed by the formation working against the cutting edge 58, must move away from the cutting edge 58 to leave the cutting face 22. The inner edge 116 of the cutting face 22 is a likely location for exiting debris but is crowded if the bit body surface 64 is too close to the inner edge 116. By creation of the clearance cut 114, additional flow area is created in which to sweep debris away.

In FIG. 9, the frontal region 52 of stud base 54 is exposed, and several beneficial effects result. Access is improved for removing a damaged stud 10 from a bit body 28. Likewise, any possible stress concentration induced in the frontal region 52 of stud base 54 would be minimal absent full enclosure and would tend to be relieved by local yielding in the bit body. In addition, tension in the frontal region 52 is reduced since the lower end of stud base 54 is not retained in a manner to impose bending loads.

Figure 10:
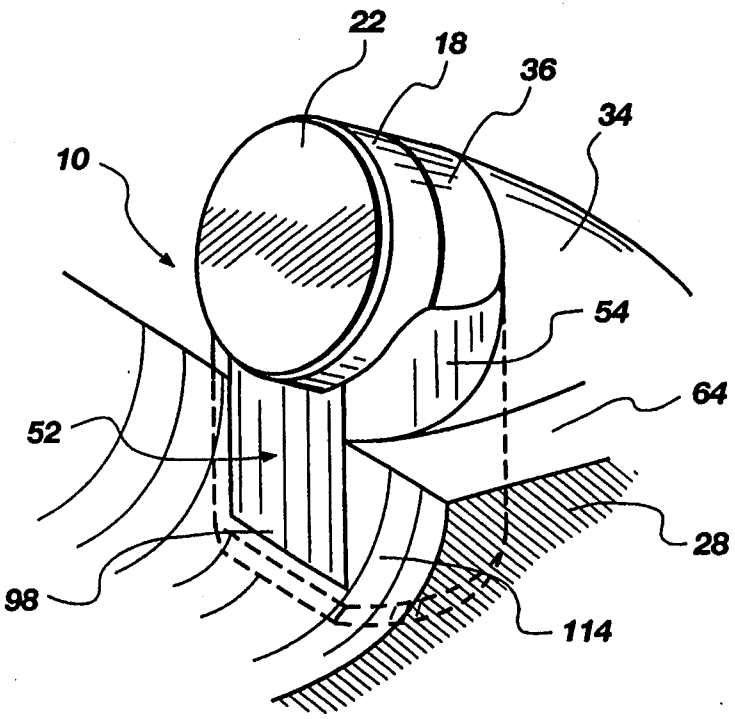
FIG. 10 is a perspective view of a stud installed in a bit body wherein the frontal portion of the stud base is flat.

FIG. 10 demonstrates the stud 10 of FIG. 9 with a flat exposed surface in frontal region 52. Thus, frontal region 52 is parallel to clearance cut 114 near the bit body surface 64. The frontal region 52 also results in smoother flow of drilling fluid without perturbations of the flow, obstruction of debris flowing therein or erosion of a protruding section at frontal region 52.

Figure 11:
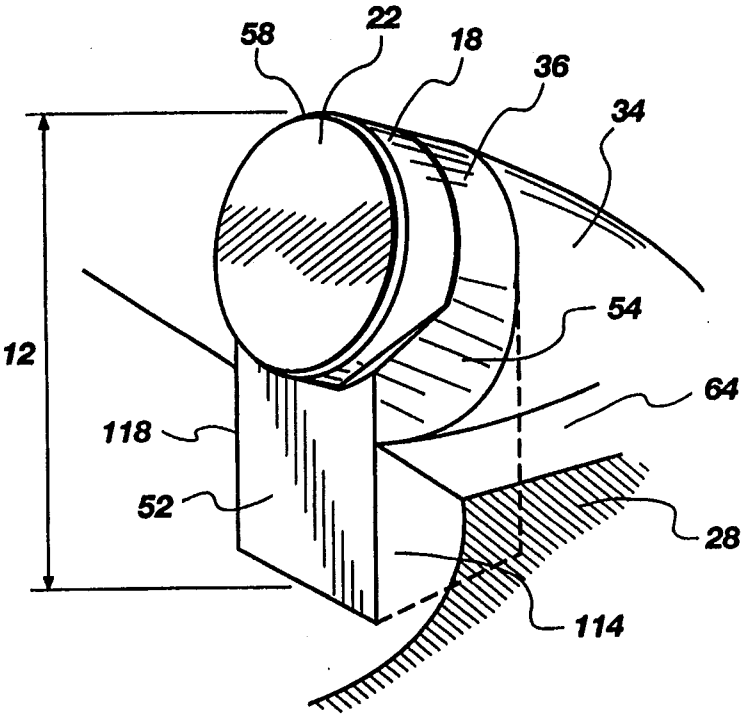
FIG. 11 is a perspective view of stud installed in a bit body wherein the stud base is rectangular in cross section.

FIG. 11 demonstrates an alternate embodiment of a stud 10 wherein the stud base 54 is rectangular in cross section. Again, the reach 62 of the cutting edge 58 above the bit body 28 due to the clearance cut 114 is substantial. Thus, improved cutting due to improved debris removal results. In addition, since the maximum stress exists at the outermost fiber, the surface most distant from the neutral axis of a section, as discussed above, the frontal region 52 sees reduced stress. That is, the rectangle is configured to have a larger moment of inertia when loaded from the direction of the frontal region 52 than would a cylinder of equal cross-sectional area. In general, a square having a side equal to the diameter of a circle has a greater moment of inertia than does the circle. Likewise a square of area equal to that of a circle has a larger moment of inertia. Thus, suitable design of the orientation and area of a rectangular stud base 54, can increase stiffness with less cross section. Therefore, material and spacing can be equivalent or better than those of a cylindrical stud base 54, while offering increased resistance to bending. Although the front corners 118 of the stud base 54 might benefit from rounding to prevent undue stress concentration at a sharp edge, the overall design reduces maximum stress at the critical frontal region 52. In addition, the other features to eliminate bending stresses and stress concentrations, from the interference or compression fit discussed above, are also seen in this configuration. Similarly, the ability for access for removal of the brazed-in stud 10, to repair a bit is maximized in this configuration.

Figure 12:
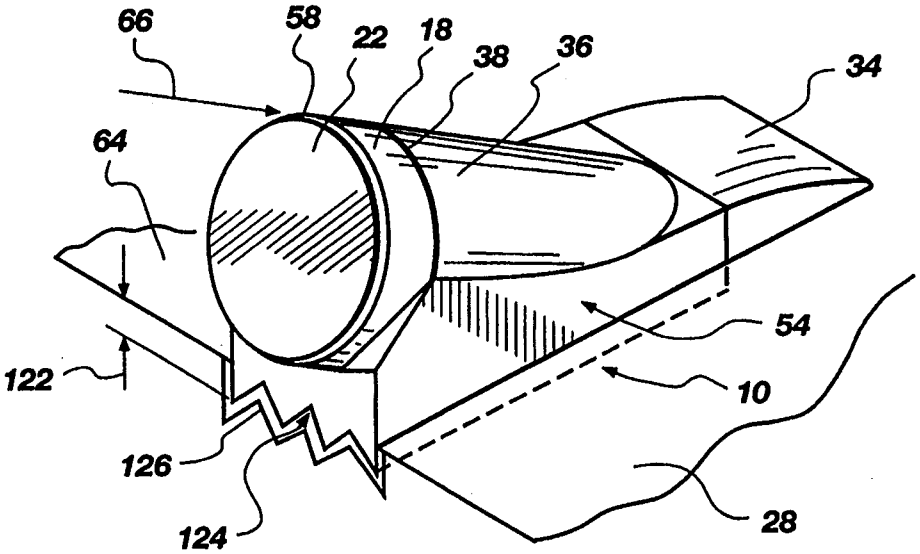
FIG. 12 is a perspective view of stud design wherein the stud base has a rectangular cross section penetrated by grooves which serve to align the stud base in the bit body and also received increased brazing area.

FIG. 12, shows a configuration for a stud 10 which requires almost no buttress 34. That is, the peak 36 of the stud 10 is its own buttress extending from the mounting interface 38 to the buttress 34 in a profile replicating that of cutting face 22 and backing layer 18. Although requiring a somewhat complex shape as shown in FIG. 12, the design for the stud 10 in this configuration may require somewhat less depth 122 for insertion of the stud 10 into the bit body 28 below the bit body surface 64. The cutting force 66 exerted on the cutting face 22 will be transferred directly along the stud 10 virtually without a bending effect, as can be seen from a static analysis of the load paths as known in the engineering art. Thus, the tendency to tear the stud base 54 away from the bit body 28 is substantially eliminated. Also, the design of FIG. 12 shows grooves 124 configured in the stud base 54. The grooves 124 provide increased surface area with a more favorable orientation for brazing. That is, any force which would tend to pull the stud 10 away from the bit body surface 64 of the bit body 28 is resisted by more braze 126 on grooves 124 and that braze 126 is in a more favorable orientation as seen in a stress analysis as known in the engineering art for such a structure.

Figure 13B:
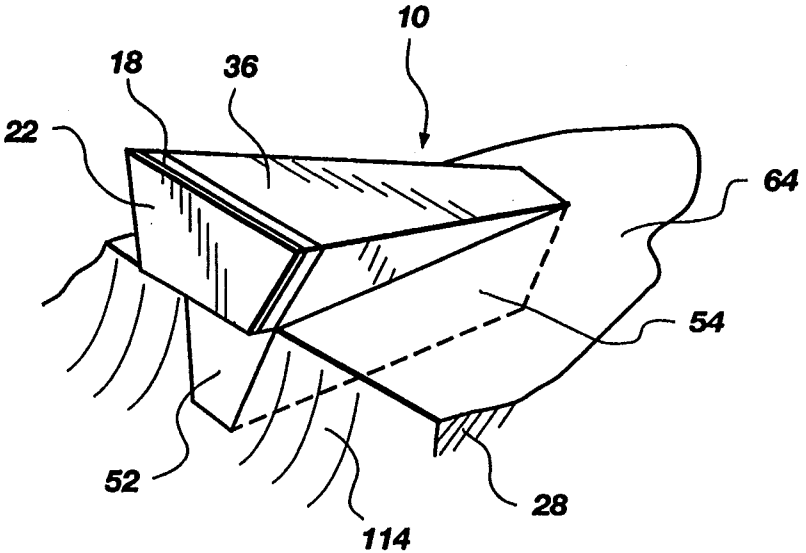
FIG. 13B is a perspective view of a self-buttressing stud having a trapezoidal frontal cross section for maximum cutter density in the curved crown of a bit body.
Figure 13C:
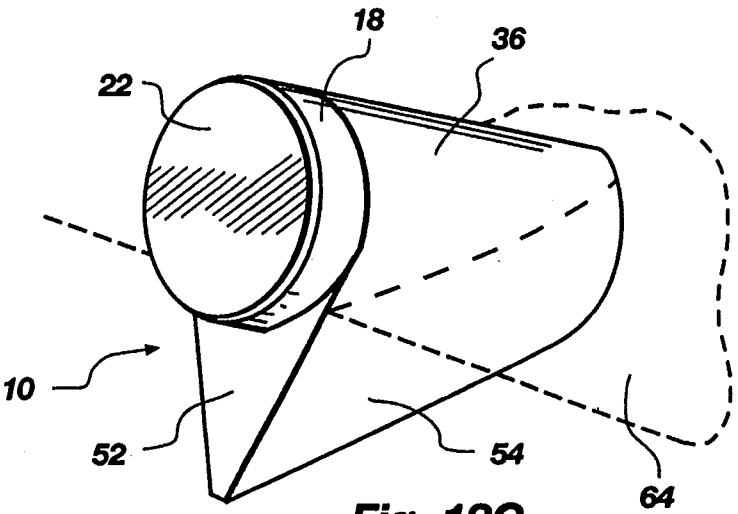
FIG. 13C is a perspective view of a stud having a base whose frontal cross section resembles a cylinder merging into a self-buttressing trapezoid providing large shear area for brazing yet capable of receiving circular polycrystalline diamond compacts.
Figure 13A:
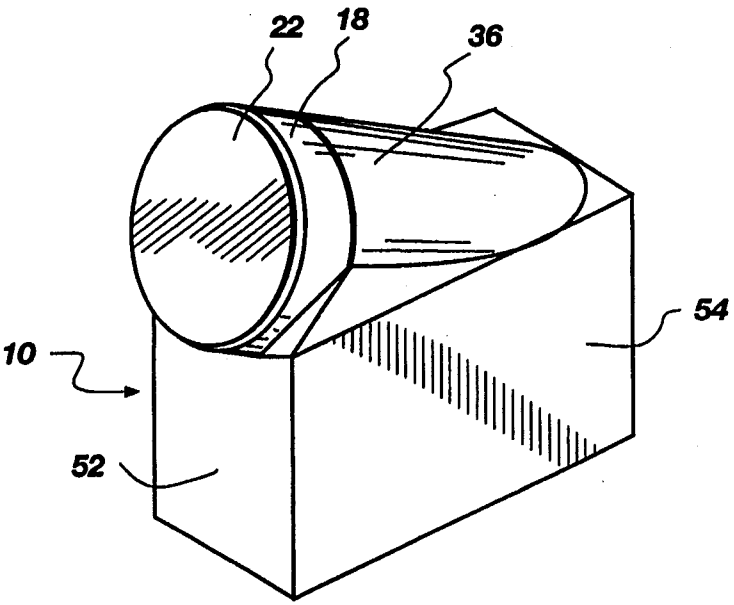
FIG. 13A is a perspective view of a self-buttressing stud having a deep rectangular base.
Figure 13E:
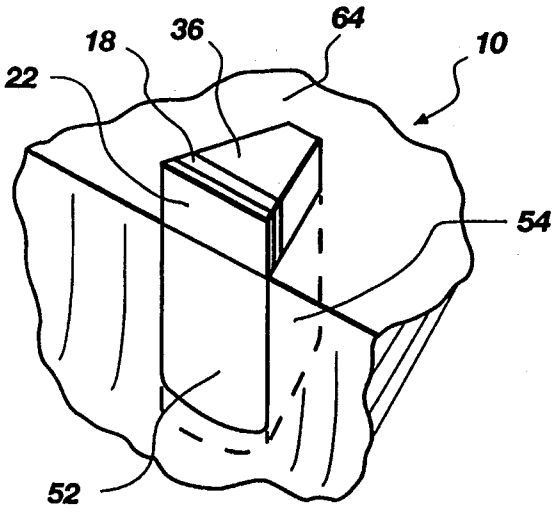
FIG. 13E is a perspective view of a stud having a trapezoidal cross section.
Figure 13D:
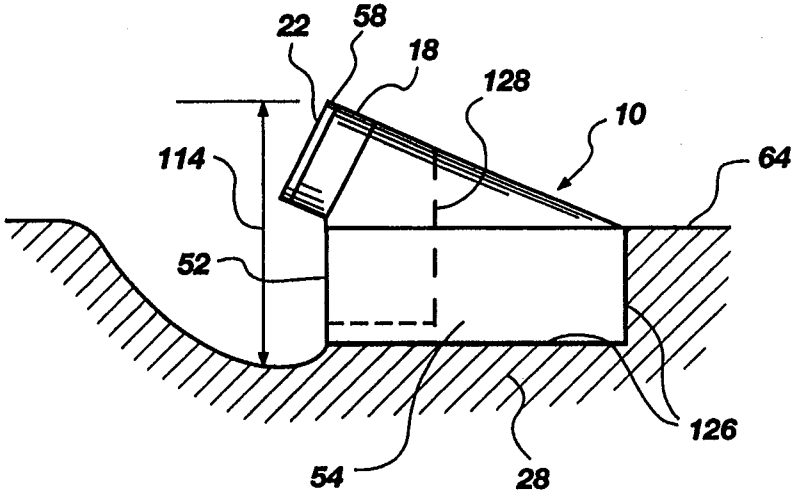
FIG. 13D is a side elevation view of the stud of FIG. 13A compared with a conventional stud shown in phantom.
Figure 21:
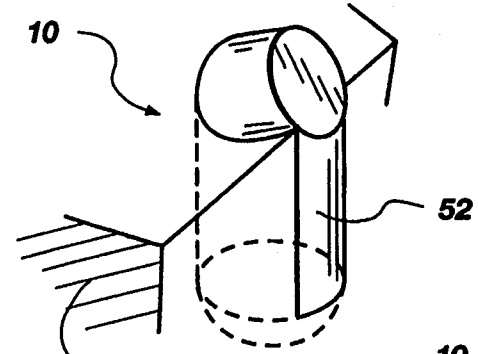
FIG. 21 shows a perspective view of a cylindrical stud base with a hemispherical end for improved seating for retention in the bit body under moment loading, and having an exposed frontal area not surrounded by the crown on the bit body.
Figure 22:
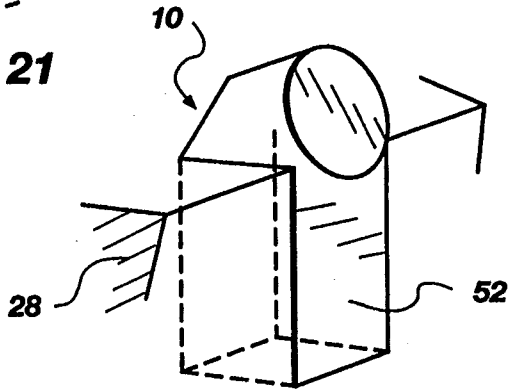
FIG. 22 is a perspective view of a rectangular stud base having a relatively large depth to width aspect ratio and an open frontal area not surrounded by the crown of the bit body.

FIGS. 13A, 13B and 13C demonstrate a stud 10 which is essentially self-buttressed. As discussed above, such a design eliminates the need for the buttress 34 in bit body 28. A clearance cut 114 as shown in FIGS. 9–11 may leave the frontal region 52 open for easy assembly and disassembly during repair. Likewise, sufficient clearance for debris to escape in front of the stud 10 would be available. The frontal profile of the cutting face 22 projects rearward normal thereto for the depth of the stud. The formation also applies force axially with respect to the bit body 28. The stresses are primarily compressive; the forces that create bending and its associated tensile stresses in stud 10 are reduced. In FIGS. 13B and 13C, the stud base 54 could be tapered for fitting more studs 10 into the crown of a smaller diameter bit body 28. One advantage to the geometric configurations of FIGS. 13A, 13B, 13C and 13E is that the stud 10 can be brazed, such that the braze will be subjected principally to shear and compressive stresses only, yet the stud 10 can be easily removed by melting the braze and tapping the stud 10 forward out of its position in the bit body 28. FIG. 13D shows how the studs of FIGS. 13A–13C might be emplaced in practice to give a maximum clearance cut 114 for a clean cutting, completely supported, self-buttressed, removable stud 10. A conventional stud 128 is shown in phantom in FIG. 13D for comparison purposes.

Figure 14:
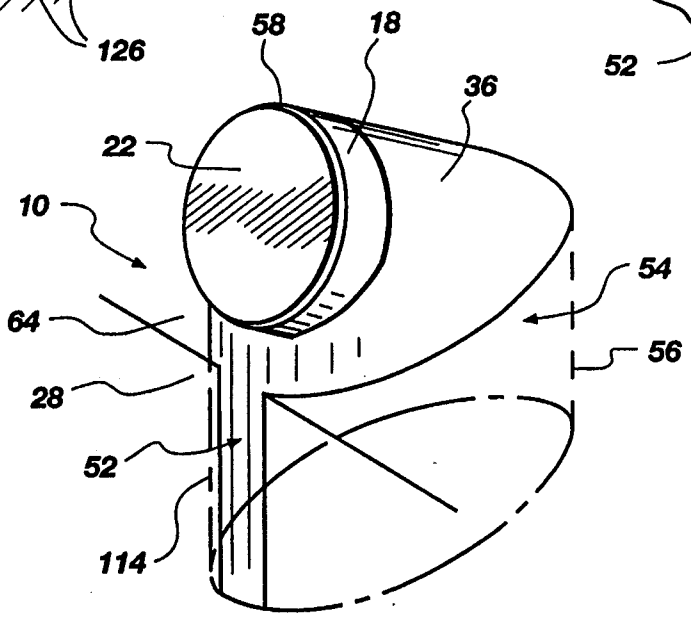
FIG. 14 is a perspective view of a self-buttressing stud having a base with elliptical cross section and a flat exposed frontal area.

FIG. 14 shows an alternate concept using an elliptical or ovoid cross section for the stud base 54 of stud 10. Again, the peak 36 of stud 10 simply recedes to the bit body surface 64 toward the back region 56 of the stud 10. This configuration avoids any sharp corners or radical changes in section. Likewise, it can have a frontal region 52 which is flush with the clearance cut 114 in the bit body 28. Most importantly perhaps, it provides a narrow profile but a large base in the direction of force on the stud 10, the direction of the major axis of the ellipse.

FIG. 15 shows an alternate means by which to create a layered stud 10. Inner core 12 in this case is made of a tougher material having high fracture toughness sandwiched between outer layers 14 of a harder material having abrasion resistance. The cutting face 22 mounted to its backing layer 18 would be attached to the stud 10 in the conventional manner. The stud base 54 could still be in any configuration which has been discussed previously above. Similarly, just as the studs 10 of FIGS. 3, 4, 5A and 5B could have multiple layers of graduated material properties, the stud 10 of FIG. 15 could be made with multiple layers of alternating tough and hard materials. Even on the frontal region 52, the close proximity of outer layers 14, whether a single layer or multiple interleaved layers, would inhibit abrasion and erosion of the frontal region 52. Meanwhile, the presence of the tough material in inner core 12, whether single or multiple layers interleaved, would provide improved resistance to dynamic loading and crack propagation.

FIGS. 16 and 17 show one possible configuration in which the inner core 12 is preferably cylindrical with the outer layer 14 being another cylinder offset eccentrically from the inner core 12. Alternatively, core 12 could have an elliptical, kidney shaped or semi-circular cross section as dictated by a fracture mechanics analysis. Inner core 12 gives toughness while outer layer 14 provides hard abrasion resistance. Inner core 12 may alternatively be of harder material while the more voluminous outer layer 14 is not as hard. Thus, the increased abrasion resistance would exist in the frontal region 52 while the generalized tough support would exist in the back region 56.

FIGS. 18 and 19 show an additional modification of the design of FIG. 15. To improve the fracture resistance on the frontal region 52, a flared tough inner core 12 is broad in the frontal region 52 and is reduced as it approaches the back region 56 flanked by hard outer layers 14.

Figure 20:
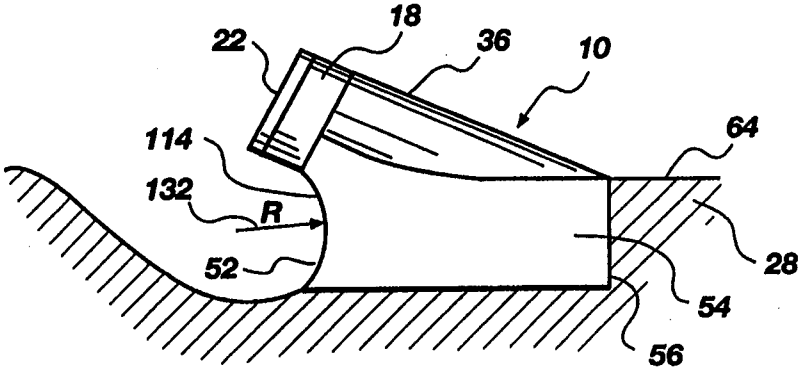
FIG. 20 is a side view of a section of a stud set in a bit body having a large undercut radius in front of the stud base to reduce stress concentrations and provide for clearance of debris.
Figure 24:
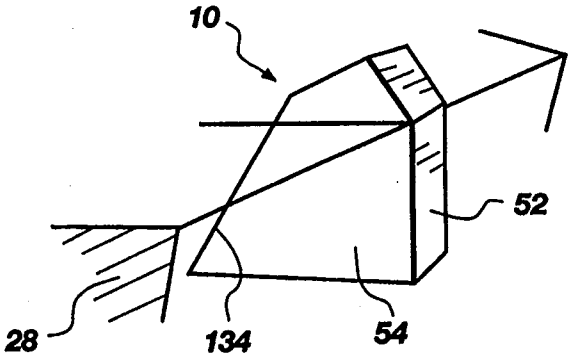
FIG. 24 is a perspective view of a rectangular body having a buttress shape and supporting a rectangular cutting face and having an exposed frontal area.
Figure 23:
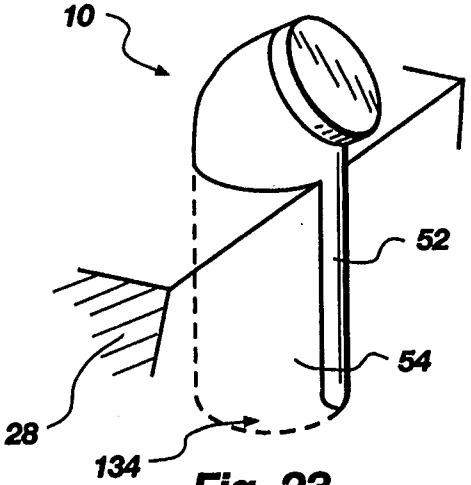
FIG. 23 is a perspective view of a stud base similar to that of FIG. 21 with a spherical end to prevent unseating under the couple induced during operation, and an open front to reduce stress concentrations and to permit removal of braze so that replaceable studs can be removed from the bit body.

In FIG. 20, a modification is shown which might apply to any of the foregoing designs or a monolithic carrier element. The self-buttressed stud 10 is further provided with clearance cut radius 132 on clearance cut 114 and on frontal region 52 such that a large, smooth curvature will exist to reduce stress concentrations and expedite removal of debris.

Figure 26:
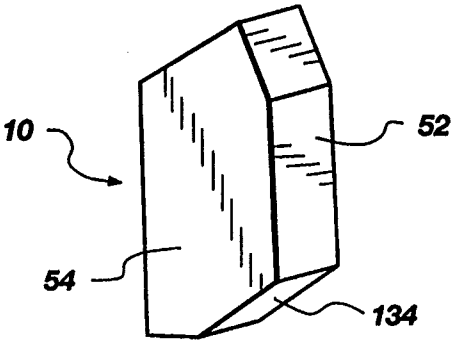
FIG. 26 is a perspective view of one end of a stud base having a rectangular cross section with one corner truncated for better securement to the crown of the bit body.
Figure 25:
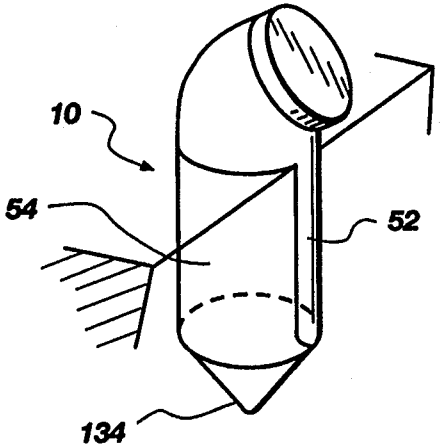
FIG. 25 is a perspective view of a stud base similar to those of FIGS. 21 and 23, having a conical end for securing the stud base in the crown of the bit body.

FIGS. 21–26 demonstrate other configurations which may have cross sections of single or multiple regions. Studs 10 may be brazed into bit bodies 28, leaving the frontal region 52 of each stud 10 exposed. Moreover, in FIG. 23, a seating surface 134 (hemispherical in the shown embodiment) is formed on stud base 54 to secure the stud in the crown of bit body 28. Similarly, a slotted shape could be used for the seating surface 134 in FIG. 24. Also, FIGS. 25 and 26 show a conical and a trapezoidal seating surface 134, respectively. Such a seating surface 134 provides proper orientation for rapid brazing of a stud base 54 into the crown of a bit body 28. Moreover, the seating surface 134 also provides a wedging effect which prevents the stud 10 from shifting position under the various directional loads which might occur during operation. Thus, seating surface 134 with a matingly configured recess in the bit body 28 into which the forces incident to drilling will drive the stud base 54, prevents a stud 10 from working loose from its braze in the bit body 28. Perhaps, most importantly, the seating surface 134, particularly with tapered or rectangular stud configurations, keeps the stud 10 from rocking out of the bit body 28 if the braze fails in shear under the load of the moment or couple imposed by the formation at the outermost edge of the cutting face 22. In each case shown in FIGS. 21–26, the frontal region 52 can be exposed for easy access for brazing as well as to provide stress relief as discussed above.

Figure 27:
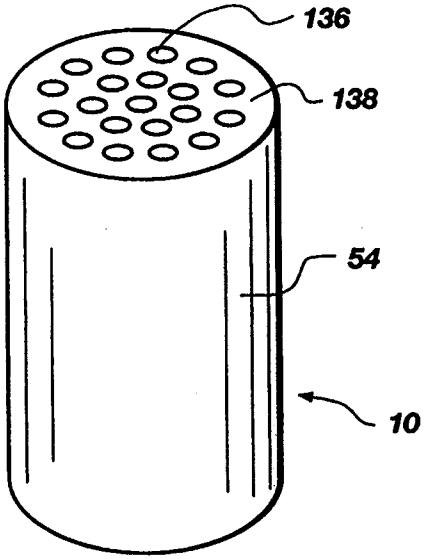
FIG. 27 is a perspective view of a segment taken from a stud of cylindrical cross-section having prestressed wires forming rods embedded in a matrix.
Figure 28:
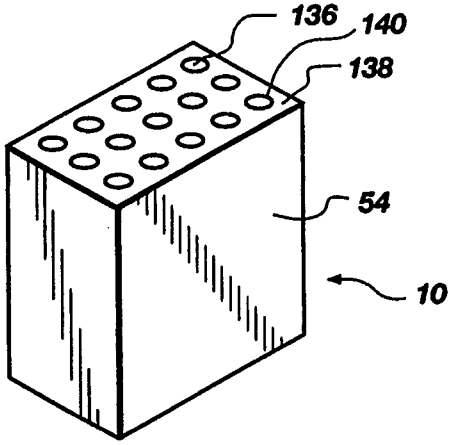
FIG. 28 is a perspective view of a segment taken from a stud of rectangular cross-section having prestressed wires forming rods embedded in a matrix.

FIGS. 27 and 28 show a perspective view of a cylindrical and rectangular cross-sectioned stud base 54 in accordance with the present invention. In these embodiments a cobalt tungsten carbide stud 10 is formed with embedded wires 136 of a high-strength alloy such as nickel, beryllium, copper, Inconel (Trademark of International Nickel Co., Inc.), or a suitable tungsten or steel alloy. The preferred embodiment uses wire. Nevertheless according to the manufacturing process used, the embedded wires 136 may properly be described as rods or cores. The embedded wires 136 run parallel to the longitudinal axis of stud base 54. The effect of the embedded wires 136 is to prestress the matrix 138 of harder material in compression. The use of additional single or multiple outer layers as discussed above can also be used in this configuration.

The manufacturing process to make the prestressed stud base 54 can include sintering of a powdered metal in a mold or other forming means which has been prefilled with an array of embedded wires 136. Each wire preferably has a pattern about its outer surface 140, at its outer diameter, to prevent excessive smoothness. The normal wire finish quality may be sufficient to make the outer surface 140 of embedded wires 136 engage the matrix 138.

Sintering bonds the powdered metal, creating matrix 138 around embedded wires 136. Under the annealing effect of heat, the entire stud base 54 comes to thermal equilibrium in a stress-free state. Embedded wires 136 have a significantly higher coefficient of thermal expansion than the cobalt tungsten carbide of matrix 136. Thus, as stud base 54 cools after manufacture, embedded wires 136 attempt to contract more than matrix 138, creating tension in embedded wires 136 which are stretched, and corresponding compression in matrix 138. Compressive stresses in matrix 138 may approach 85,000 pounds per square inch in the preferred embodiment.

The features of each embodiment disclosed may generally be combined with features of other consistent configurations and remain within the scope of the claims. Many additions, deletions and modifications to the invention as disclosed and depicted in terms of the preferred and alternative embodiments may be made without departing from the scope of the invention set forth in the following claims.

What is claimed is:

1. A bit of the rotary drag type for drilling subterranean formations, said bit having a shank secured to a bit body including a crown defined by a bit body surface and having at least one recess therein for holding a carder element, said carder element comprising:

a base secured to said bit for extending beyond said bit body surface, said base including;

a fracture resistant first region, said first region being a core having a first level of fracture toughness; and an abrasion resistant second region, said second region being positioned to form at least one outer layer and having a second level of fracture toughness, the second level of fracture toughness being lower than said first level of fracture toughness of said first region; and a mounting surface on said base for receiving a cutting element, said cutting element comprising a cutting face.

2. The bit of claim 1, wherein said at least one outer layer has a greater hardness than the hardness of said core.

3. The bit of claim 2, wherein said core is comprised of steel.

4. The bit of claim 2, wherein said at least one outer layer is comprised of tungsten carbide.

5. The bit of claim 2, wherein said core is comprised of tungsten carbide having a large grain size.

6. The bit of claim 2, wherein said core is comprised of tungsten carbide having a high cobalt content.

7. The bit of claim 1, wherein said core is comprised of a plurality of rods.

8. The carrier element of claim 7, wherein said plurality of rods is axially aligned with and embedded in a matrix.

9. The carrier element of claim 8, wherein said plurality of rods is secured to said matrix for maintaining compression therein, said plurality of rods being in tension.

10. The carrier element of claim 9, wherein said matrix and said at least one outer layer are comprised of the same material.

11. The bit of claim 7, wherein said plurality of rods is made of a material having a higher coefficient of thermal expansion than that of a surrounding matrix.

12. The bit of claim 7, wherein a rod of said plurality of rods is provided with a surface adapted for engaging a surrounding matrix material.

13. The bit of claim 1, wherein said cutting element is further comprised of a backing layer secured to said mounting surface on said base for supporting said cutting face thereon.

14. The bit of claim 13, wherein said cutting face is further comprised of diamond.

15. The bit of claim 14, wherein said cutting element is comprised of a polycrystalline diamond compact.

16. The bit of claim 1, wherein said base is of circular cross-section.

17. The bit of claim 1, wherein said base is of rectangular cross-section.

18. The bit of claim 1, wherein said base is of trapezoidal cross-section.

19. The bit of claim 1, wherein said bit is further comprised of a buttress located adjacent said base on a side opposite said cutting face for supporting said base during operation.

20. The bit of claim 1, wherein said cutting face has a profile which extends through said base in a direction substantially normal to said cutting face.

21. The bit of claim 20, wherein said base further comprises a back region which extends from said cutting element substantially to said bit body surface to form a self-buttressing structure.

22. The bit of claim 1, wherein said base is of elliptical cross-section.

23. The bit of claim 1, wherein said base has a rectangular frontal profile.

24. The bit of claim 1, wherein said base has a trapezoidal frontal profile.

25. The bit of claim 1, wherein said second region is comprised of an outer layer oriented transversely to said cutting face.

26. The bit of claim 25, wherein said first region is comprised of at least one layer oriented within said outer layer.

27. The carrier element of claim 26, wherein said at least one layer is comprised of steel.

28. The carrier element of claim 26, wherein said outer layer is comprised of cemented tungsten carbide.

29. The bit of claim 26, wherein said first region is further comprised of a plurality of layers.

30. The bit of claim 29, wherein said first layer has a nonuniform width decreasing from a maximum width proximate :said mounting surface.

31. The carrier element of claim 29, wherein the properties of adjacent layers in said plurality of layers alternate between high toughness with a high coefficient of thermal expansion and high hardness with a low coefficient of thermal expansion.

32. The base of claim 29, wherein each layer of said plurality of layers has greater hardness than that of the next layer radially inward therefrom.

33. The base of claim 29, wherein said first region is comprised of a plurality of layers, each layer of said plurality of layers having greater toughness than that of the next layer radially outward therefrom.

34. The bit of claim 1, wherein the cross section of said first region is oriented eccentrically with respect to the cross section of said second region.

35. The bit of claim 1, wherein said base is further comprised of a seating surface on a proximal end thereof for mating with said bit body.

36. The bit of claim 1, wherein said first region is further comprised of a plurality of rods embedded in a matrix and secured thereto for pre-stressing said matrix in compression.

37. The bit of claim 36, wherein said second region forms an outer layer of the same material as said matrix.

38. A bit of the rotary drag type for drilling subterranean formations, said bit having a shank secured to a bit body including a crown defined by a bit body surface and having at least one recess therein for holding a carder element, said carder element comprising:

a base secured to said bit for extending beyond said bit body surface, said base including;

a fracture resistant first region;

an abrasion resistant second region; and a frontal region below said mounting surface, said frontal region being exposed when said base is secured in said recess thereby providing an area of lower stress concentration with respect to said bit body and an area of lower tension stress loading of said base by reducing bending loads of said base with respect to said bit body; and a mounting surface on said base for receiving a cutting element, said cutting element comprising a cutting face.

39. A bit of the rotary drag type for drilling subterranean formations, said bit having a shank secured to a bit body including a crown defined by a bit body surface and having at least one recess therein for holding a carder element, said carder element comprising:

a base secured to said bit for extending beyond said bit body surface, said base including:

a fracture resistant first region;

an abrasion resistant second region: and a grooved surface proximate the end of said base secured to said bit body for enhanced securement to a mating surface on said bit body: and a mounting surface on said base for receiving a cutting element, said curing element comprising a cutting face.

40. A bit of the rotary drag type for drilling subterranean formations, said bit having a shank secured to a bit body including a crown defined by a bit body surface and having at least one recess therein for holding a carrier element, said carrier element comprising:

a base secured to said bit for extending beyond said bit body surface, said base including:

a fracture resistant first region;

an abrasion resistant second region: and a front located about the outer perimeter of said base; and a mounting surface on said base for receiving a cutting element, said cutting element comprising a cutting face wherein said front located about said outer perimeter proximate said cutting element and said bit body is recessed proximate said front thereby providing an area of lower stress concentration with respect to said bit body, an area of lower tension stress loading of said base by reducing bending loads of said base with respect to said bit body, and the removal of debris from said base of said bit during said drilling of subterranean formations.

41. A cutting element for a rotary drag bit for drilling subterranean formations, said rotary drag bit having a bit body and a bit body surface, said cutting element comprising:

a fracture resistant base secured to said bit for extending beyond said bit body surface, said base comprising a lattice of a base material having an outer perimeter implanted with atoms of a second material thereby placing said lattice of base material in compression to allow higher tensile loads of said lattice of base material before the maximum allowable stress level is reached thereof during said drilling subterranean formations; and;

a polycrystalline diamond compact secured to a distal end of said base for cutting a subterranean formation.

42. A cutting element for a rotary drag bit for drilling subterranean formations, said rotary drag bit having a bit body and a bit body surface, said cutting element comprising:

a fracture resistant base secured to said bit for extending beyond said bit body surface, wherein said base comprises an outer surface ground in a direction parallel to the longitudinal axis thereof; and a polycrystalline diamond compact secured to a distal end of said base for cutting a subterranean formation.

43. A cutting element for a rotary drag bit for drilling subterranean formations, said rotary drag bit having a bit body and a bit body surface, said cutting element comprising;

a fracture resistant base secured to said bit for extending beyond said bit body surface, wherein said base is comprised of an arcuate frontal surface formed shaped to match an adjacent arcuate surface of said bit body; and a polycrystalline diamond compact secured to a distal end of said base for cutting a subterranean formation.

44. A cutting element for a rotary drag bit for drilling subterranean formations, said rotary drag bit having a bit body and a bit body surface, said cutting element comprising:

a fracture resistant base secured to said bit for extending beyond said bit body surface, said base comprising a core and an outer layer having a locking surface therebetween, said core having a first coefficient of thermal expansion, and said outer layer having a second coefficient of thermal expansion less than said first coefficient of expansion, for inducing tension in said core and compression in said outer layer; and a polycrystalline diamond compact secured to a distal end of said base for cutting a subterranean formation.

* * * * *

UNITED STATES PATENT AND TRADEMARK OFFICE

CERTIFICATE OF CORRECTION

PATENT NO. : 5,431,239

DATED : 7/11/95

INVENTOR(S) : Tibbitts et al.

It is certified that error appears in the above-indentified patent and that said Letters Patent is hereby corrected as shown below:

On the title page, on the line before "Appl. No.: 44,938", insert --Assignee: Baker Hughes Incorporated--;

On the title page, on the line following "Primary Examiner—David J. Bagnell", insert --Attorney, Agent, or Firm—Trask, Britt & Rossa--;

In Column 3, line 54, change "-096" to --'096--;

In Column 6, line 30, change "cutter" to --Cutter--;

In Column 7, line 31, after "installed", change "is" to --in--;

In Column 16, line 34, change "carder" to --carrier-- (both occasions);

In Column 16, line 36, change the semicolon to a colon;

In Column 17, line 56, delete the colon before "said";

In Column 18, line 17, change "carder" to --carrier-- (both occasions);

In Column 18, line 19, change the semicolon to a colon;

In Column 18, line 37, change "carder" to --carrier-- (both occasions);

In Column 18, line 46, change "curing" to --cutting--;

In Column 18, line 56, change the colon to a semicolon; and

UNITED STATES PATENT AND TRADEMARK OFFICE

CERTIFICATE OF CORRECTION

PATENT NO. : 5,431,239

DATED : July 11, 1995

INVENTOR(S) : Tibbitts et al.

It is certified that error appears in the above-indentified patent and that said Letters Patent is hereby corrected as shown below:

In Column 19, line 15, delete the semicolon after "and".

Signed and Sealed this

Twenty-eighth Day of November 1995

*Attest:*

Bruce Lehman

BRUCE LEHMAN

*Attesting Officer*

*Commissioner of Patents and Trademarks*